US008657289B2

(12) United States Patent
Bond et al.

(10) Patent No.: US 8,657,289 B2
(45) Date of Patent: Feb. 25, 2014

(54) GAME COMBINING CHECKERS, CHESS AND DICE

(75) Inventors: Edward Gregory Bond, Horseheads, NY (US); John Howard Bond, Horseheads, NY (US)

(73) Assignee: Edward G. Bond, Horseheads, NY (US)

( * ) Notice: Subject to any disclaimer, the term of this patent is extended or adjusted under 35 U.S.C. 154(b) by 0 days.

(21) Appl. No.: 13/558,303

(22) Filed: Jul. 25, 2012

(65) Prior Publication Data

US 2013/0277913 A1 Oct. 24, 2013

Related U.S. Application Data

(60) Provisional application No. 61/636,599, filed on Apr. 20, 2012.

(51) Int. Cl.
*A63F 3/00* (2006.01)

(52) U.S. Cl.
USPC ..... 273/260; 273/255

(58) Field of Classification Search
USPC ..... 273/255, 261, 260, 262
See application file for complete search history.

(56) References Cited

U.S. PATENT DOCUMENTS

| | | | | | |
|---|---|---|---|---|---|
| 3,608,904 | A * | 9/1971 | Margetson | 273/288 |
| 3,794,326 | A * | 2/1974 | Bialek | 273/260 |
| 3,881,731 | A * | 5/1975 | Droney | 273/291 |
| 3,908,999 | A * | 9/1975 | Brown | 273/260 |
| 4,437,666 | A * | 3/1984 | Moylan | 273/141 R |
| 4,927,157 | A * | 5/1990 | Riihiluoma et al. | 273/260 |
| 5,011,159 | A * | 4/1991 | Fortunato et al. | 273/260 |
| D354,524 | S * | 1/1995 | Freund | D21/389 |
| 6,062,562 | A * | 5/2000 | Pardee | 273/248 |
| 6,120,029 | A * | 9/2000 | Carmichael et al. | 273/260 |
| 7,156,394 | B1 * | 1/2007 | Boyle | 273/260 |
| 2008/0093802 | A1 * | 4/2008 | Lyrberg | 273/243 |

* cited by examiner

*Primary Examiner* — Vishu K. Mendiratta

(57) ABSTRACT

A board game may be played on a board or with an electronic version thereof, that combines chess, checkers and dice to create an original game that is more dynamic than checkers, easier to learn and play than chess, and has an element of randomness that makes it hard to know who will win until the final roll of the dice. The game of the present invention simplifies play by combining classic elements. The roll of the dice determines what kind of move can be made, but the player can choose any of his/her pieces to move. Whoever captures the king wins, or, in an alternative embodiment, whoever has the last remaining piece(s) wins.

4 Claims, 4 Drawing Sheets

GAME COMBINING CHECKERS, CHESS AND DICE

CROSS-REFERENCE TO RELATED APPLICATIONS

This application claims the benefit of priority of U.S. provisional patent application No. 61/636,599, filed Apr. 20, 2012, the contents of which are herein incorporated by reference.

BACKGROUND OF THE INVENTION

The present invention relates to board games and, more particularly, to a game that combines checkers, chess and dice.

Current board-type games can be difficult to learn and have strategies that can take years to master. These games also take a long time to be resolved, with remaining pieces sometimes chasing each other around the board in the closing moves.

Other attempts to combine the games of checkers and chess are complicated and hard to learn. These games often require extra steps for pieces to be captured, changing the shape of the board, or changing the color and function of the pieces. Some versions of chess include dice, but are limited because often the rolls give options that are not possible on the board.

As can be seen, there is a need for an improved game that combines checkers and chess and adds a chance element with dice.

SUMMARY OF THE INVENTION

In one aspect of the present invention, a game comprises a plurality of game pieces for each player; a king piece for each player; a first die having a plurality of chess piece designations disposed thereupon; a second die having indicia for numbers 1-6 disposed thereupon; and a board for game play.

In another aspect of the present invention, a method for playing a game combining elements of checkers, chess and dice comprises setting up a plurality of game pieces for a first player on a first side of a game board and a plurality of game pieces for a second player on a second side of the game board, the plurality of game pieces including a king piece for each player; rolling a first die, having a plurality of chess piece designations disposed thereupon, and a second die, having indicia for numbers 1-6 disposed thereupon; and moving a selected one of the plurality of game pieces, wherein the movement and number of spaces to be moved are determined by the roll of the dice and rules derived from chess.

These and other features, aspects and advantages of the present invention will become better understood with reference to the following drawings, description and claims.

DETAILED DESCRIPTION OF THE INVENTION

Figure 1:
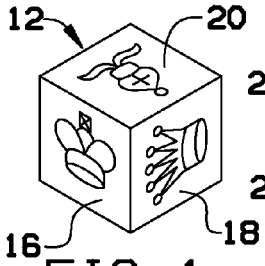
FIG. 1 is a perspective view of a chess die according to an exemplary embodiment of the present invention.
Figure 2:
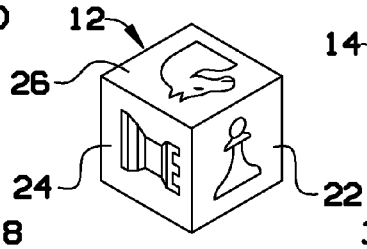
FIG. 2 is another perspective view of the chess die of FIG. 1.
Figure 3:
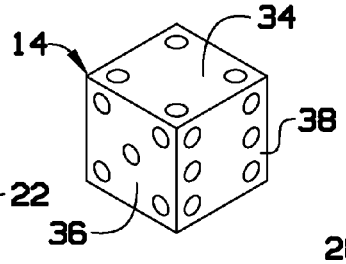
FIG. 3 is a perspective view of a number die according to an exemplary embodiment of the present invention.
Figure 4:
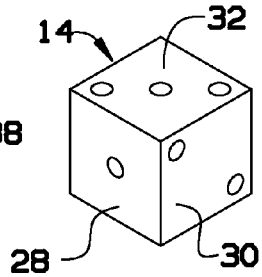
FIG. 4 is another perspective view of the number die of FIG. 3.
Figure 5:
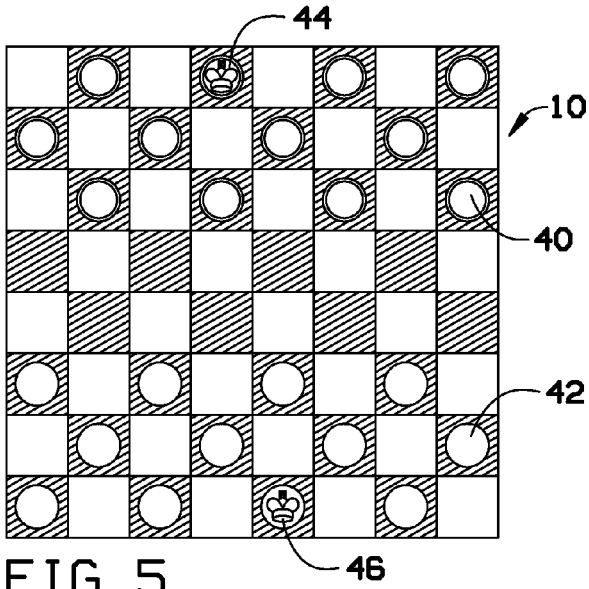
FIG. 5 is a top view of a board game set up to start play according to an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a board game that may be played on a board or with an electronic version thereof, that combines chess, checkers and dice to create an original game that is more dynamic than checkers, easier to learn and play than chess, and has an element of randomness that makes it hard to know who will win until the final roll of the dice. The game of the present invention simplifies play by combining classic elements. The roll of the dice determines what kind of move can be made, but the player can choose any of his/her pieces to move. Whoever captures the king wins, or, in an alternative embodiment, whoever has the last remaining piece(s) wins.

Referring now to the Figures, the pieces, which can be standard black checkers pieces 40 and white checkers pieces 42, can be arranged on a board 10 in the standard formation for a game of checkers. However, king pieces 44, 46 can be placed in the back row, second position from the right. The king pieces 44, 46 are placed with the reverse side up so that the king symbol is visible.

The two players determine ahead of time who will play the white/light pieces and therefore move first. They may choose to use the custom in chess, which is to have one player hide a white/light piece in one hand and a dark/black piece in the other hand and let the opponent pick blindly.

Play begins with the white/light player rolling the dice 12, 14. A number die 14 determines how many spaces must be moved. A chess die 12 determines how the piece they select 48 is to behave on the board. The chess die 12 can include a king facet 16, a queen facet 18, a bishop facet 20, a pawn facet 22, a rook facet 24 and a knight facet 26. The number die 14 can include a numerical one facet 28, a numerical two facet 30, a numerical three facet 32, a numerical four facet 34, a numerical five facet 36 and a numerical six facet 38.

The player can choose to move any piece on their side according to the roll of the dice. If the player rolls a king, a pawn or a knight on the chess die (as shown in FIGS. 12 and 13, 16 and 17, 18 and 19), the number die becomes irrelevant, and the chosen piece is to move in the manner indicated on the chess die. Capturing of opposing pieces happens according to the rules of chess.

Figure 16:
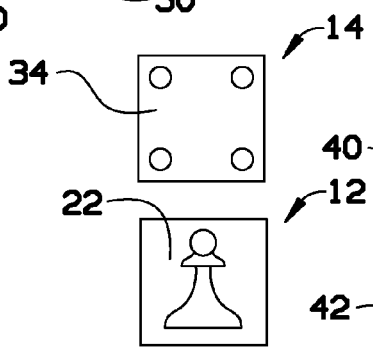
FIG. 16 is a top view showing an exemplary roll of the chess die of FIGS. 1 and 2 and the number die of FIGS. 3 and 4.
Figure 17:
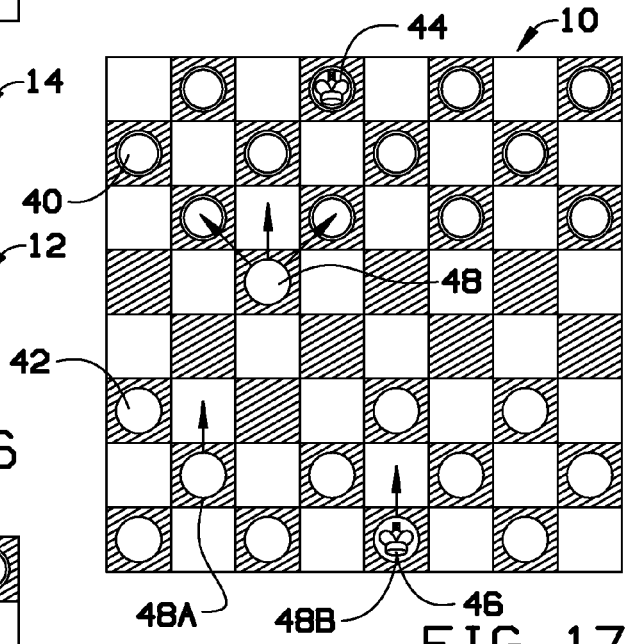
FIG. 17 is a top view of the board game showing three examples of how pieces 48, 48A and 48B can be moved based on the roll of the dice of FIG. 16.
Figure 19:
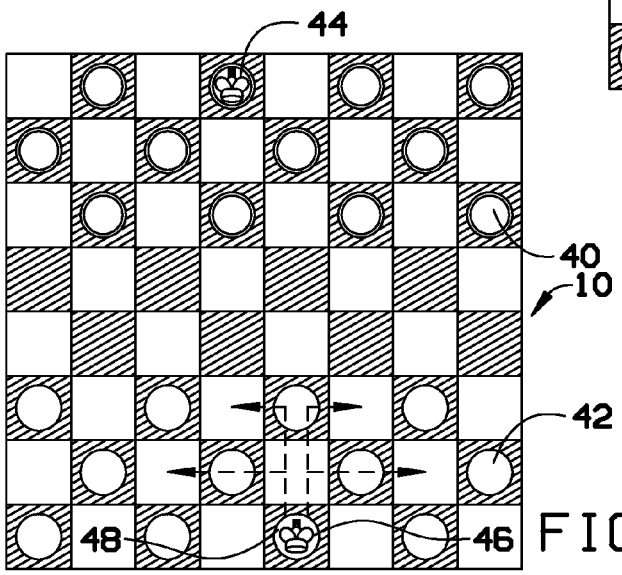
FIG. 19 is a top view of the board game showing how one of the pieces can be moved based on the roll of the dice of FIG. 18.
Figure 18:
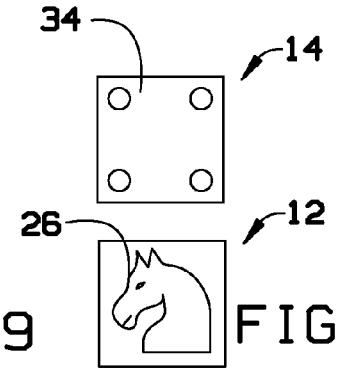
FIG. 18 is a top view showing an exemplary roll of the chess die of FIGS. 1 and 2 and the number die of FIGS. 3 and 4.
Figure 21:
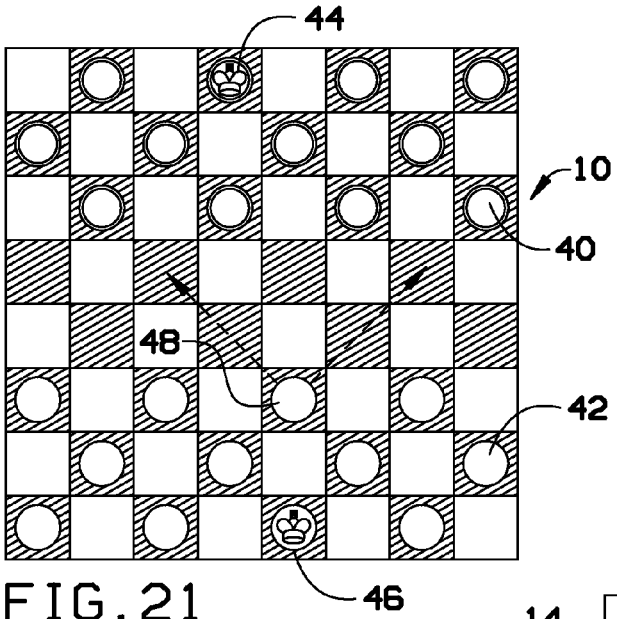
FIG. 21 is a top view of the board game showing how one of the pieces can be moved based on the roll of the dice of FIG. 20.
Figure 20:
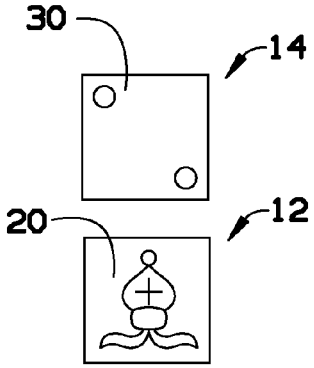
FIG. 20 is a top view showing an exemplary roll of the chess die of FIGS. 1 and 2 and the number die of FIGS. 3 and 4.
Figure 22:
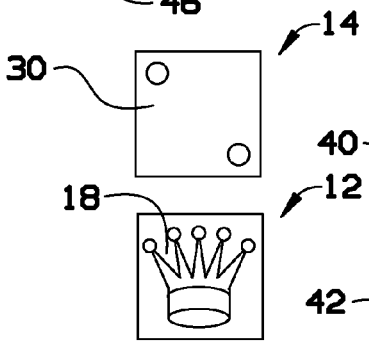
FIG. 22 is a top view showing an exemplary roll of the chess die of FIGS. 1 and 2 and the number die of FIGS. 3 and 4.
Figure 23:
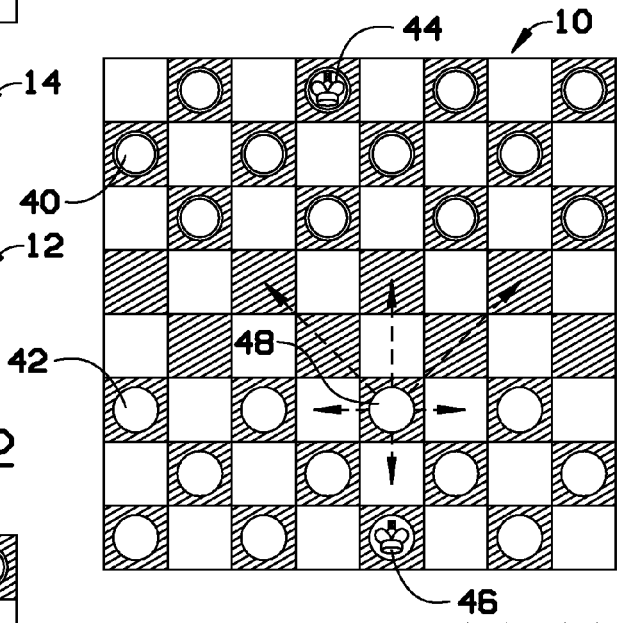
FIG. 23 is a top view of the board game showing how one of the pieces can be moved based on the roll of the dice of FIG. 22.
Figure 25:
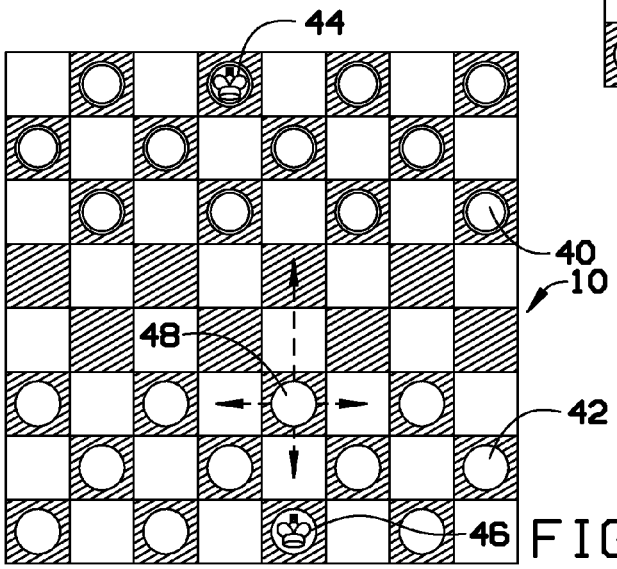
FIG. 25 is a top view of the board game showing how one of the pieces can be moved based on the roll of the dice of FIG. 24.
Figure 24:
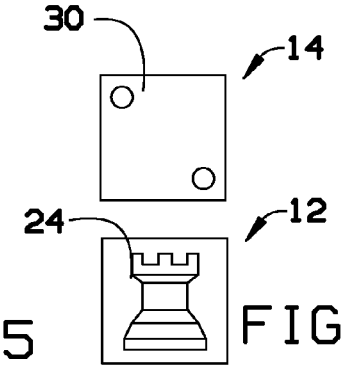
FIG. 24 is a top view showing an exemplary roll of the chess die of FIGS. 1 and 2 and the number die of FIGS. 3 and 4.

When a pawn is rolled, as shown in FIGS. 16 and 17, a player will have the option of moving forward one square, as with pieces 48A and 48B, or capture diagonally as with piece 48. As mentioned above, a user can move any piece according to the roll of the dice and the rules for moving a pawn. However, pawns do not have the option of moving two spaces, using the "en passant" rule or being promoted by reaching the other side of the board.

Figure 6:
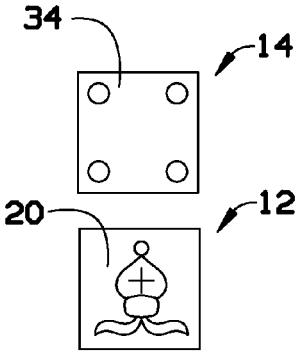
FIG. 6 is a top view showing an exemplary roll of the chess die of FIGS. 1 and 2 and the number die of FIGS. 3 and 4.
Figure 7:
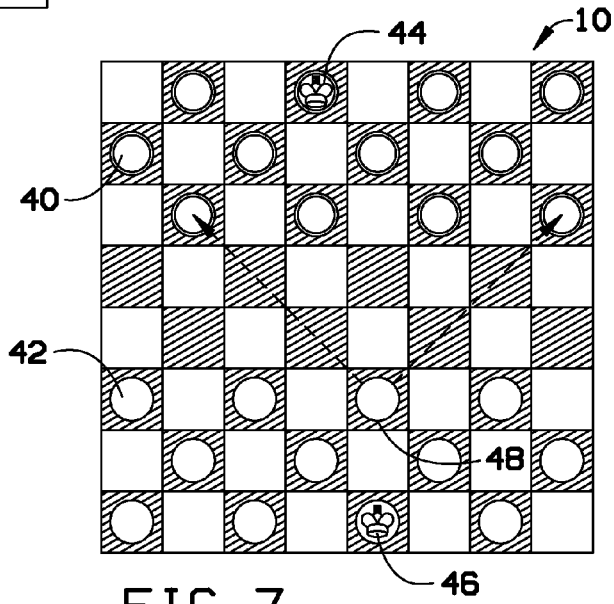
FIG. 7 is a top view of the board game showing how one of the pieces can be moved based on the roll of the dice of FIG. 6.
Figure 9:
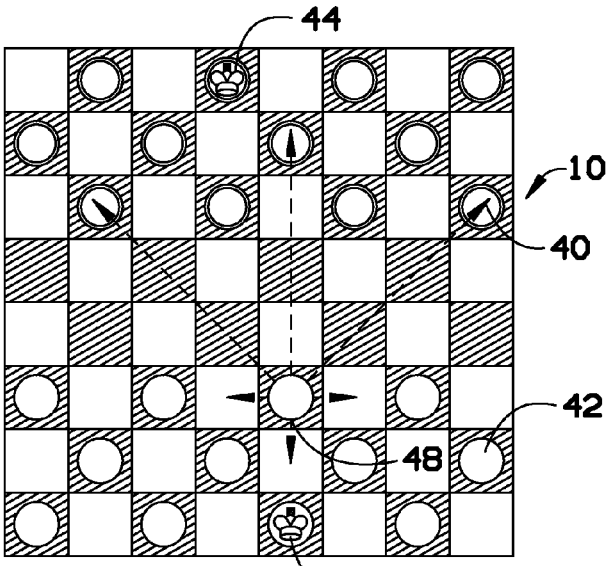
FIG. 9 is a top view of the board game showing how one of the pieces can be moved based on the roll of the dice of FIG. 8.
Figure 8:
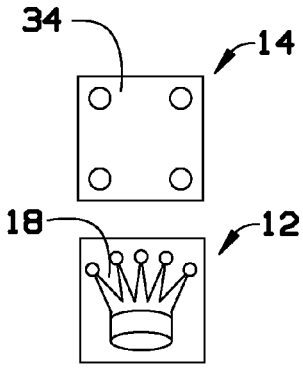
FIG. 8 is a top view showing an exemplary roll of the chess die of FIGS. 1 and 2 and the number die of FIGS. 3 and 4.
Figure 10:
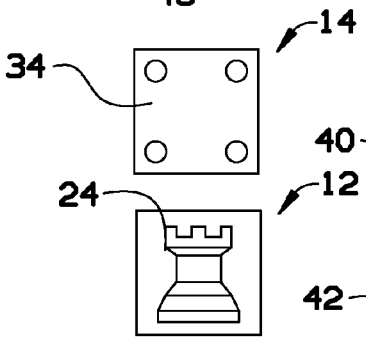
FIG. 10 is a top view showing an exemplary roll of the chess die of FIGS. 1 and 2 and the number die of FIGS. 3 and 4.
Figure 11:
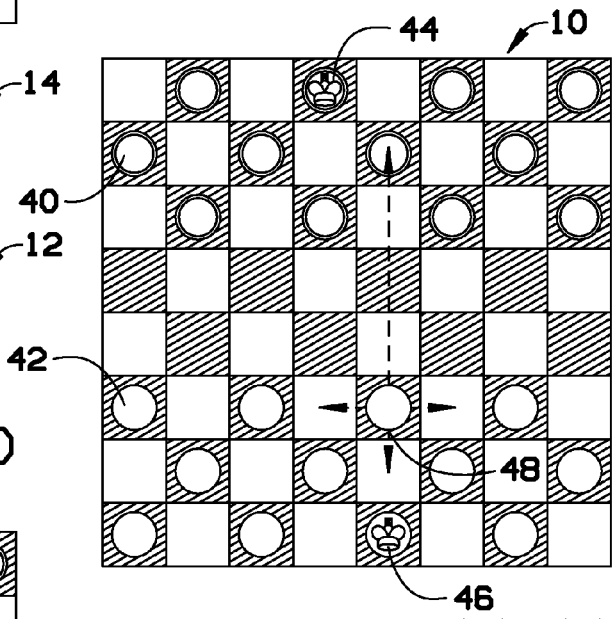
FIG. 11 is a top view of the board game showing how one of the pieces can be moved based on the roll of the dice of FIG. 10.
Figure 13:
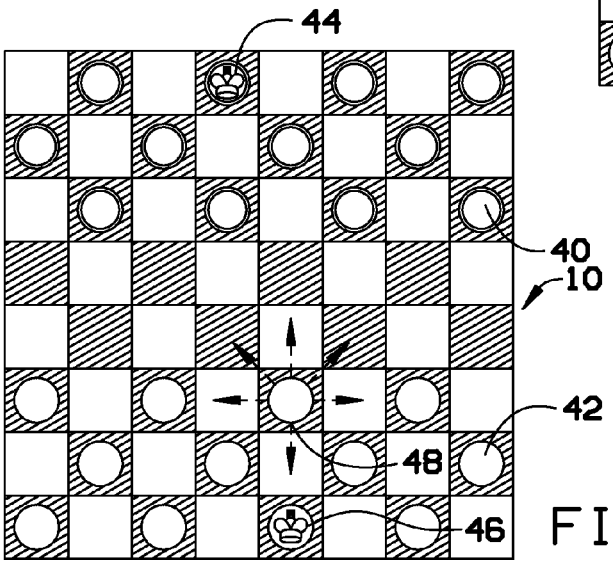
FIG. 13 is a top view of the board game showing how one of the pieces can be moved based on the roll of the dice of FIG. 12.
Figure 12:
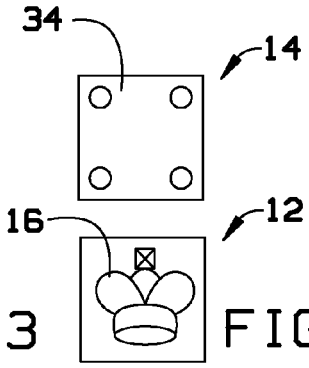
FIG. 12 is a top view showing an exemplary roll of the chess die of FIGS. 1 and 2 and the number die of FIGS. 3 and 4.

If the player rolls a bishop, rook or queen, the chosen piece must move the number of spaces indicated on the numbers die unless a) the piece captures an opposing piece (as shown in FIGS. 10 and 11); b) the piece is blocked by another piece it cannot capture, including one from its own side (as shown in FIGS. 8 and 9); or c) the piece reaches the edge of the board (as shown in FIGS. 6 and 7).

When a piece captures an opposing piece, the opposing piece is removed from the board and the capturing piece stays where the capture occurred despite the number shown on the dice. If blocked, the piece advances as far as the blocking piece will allow. The game continues until a player captures the opponent's king. There is no check or checkmate option in this game.

Figure 15:
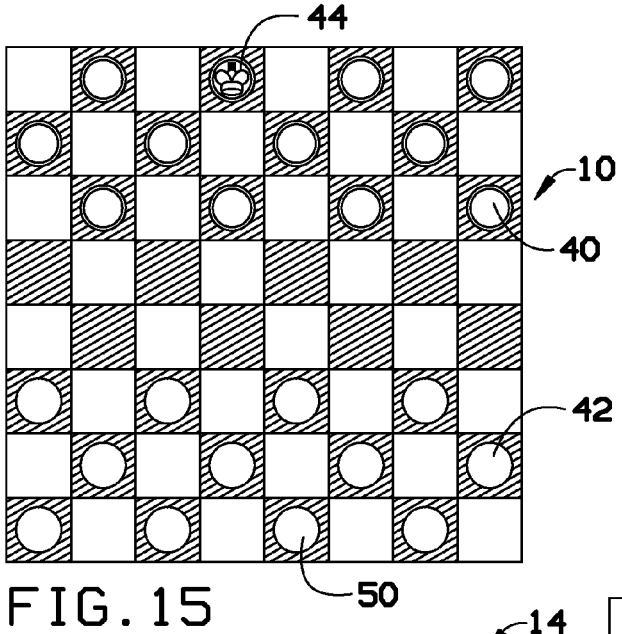
FIG. 15 is a top view of the board game showing that when a king is rolled on the player's first turn, as shown in FIG. 14, the king piece may be flipped over, hiding it as piece 50 and creating a stealth mode.
Figure 14:
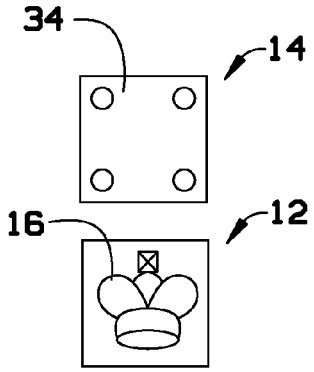
FIG. 14 is a top view showing an exemplary roll of the chess die of FIGS. 1 and 2 and the number die of FIGS. 3 and 4.

In some embodiments, a stealth mode may be created in the game. If a player rolls a king on the first move, as shown in FIGS. 14 and 15, the king piece 46 may be flipped over, resulting in a hidden king 50 and beginning stealth mode. Therefore, the players will not be sure the game is over until the king piece is captured and the piece is turned over. Another diversion from the rules of chess is that when a pawn is rolled, the selected piece can only move one space forward or capture diagonally. There is no option for the pawn to move two spaces on its first move. While that option may be useful in chess because it allows pawns to link up in a defensive diagonal pattern, there is no such advantage in this game, so the option to move two spaces on the opening move becomes unnecessary.

The standard chess/checkers board could be modified to include a tray that could be attached to flip out or swivel from the board to provide a contained space to roll the dice. The checkers would be standard, except the king piece would be decorated on the reverse side—which would face up during a typical game—using an embossing, a wood burning technique, stencil, a decal or even just by marking it with a letter "K" or a typical symbol for the king. The dice could be made, for example, using oven-baked clay, wood, paper, plastic, glass or other material suitable to making a cube, painted or otherwise labeled on each side to indicate the different chess pieces or number pips as needed.

The starting position of the pieces could be altered. For example, one variation could be to line up the pieces in two straight rows as in chess, rather than diagonally arranged as in checkers. There could be a method of choosing the starting positions of each piece randomly or according to any of the other opening variations of chess or checkers. Or the number of pieces could be increased or decreased to alter the level of difficulty.

A computer version of this game could be created that could be played on a variety of computer platforms and electronic devices such as iPads, iPods, iPhones, Android phones, Blackberries and arcade machines. Electronic games could be played against opponents who are either present or playing remotely via the Internet. Games could also be played against a computer opponent.

It should be understood, of course, that the foregoing relates to exemplary embodiments of the invention and that modifications may be made without departing from the spirit and scope of the invention as set forth in the following claims.

What is claimed is:

1. A game comprising:

a plurality of game pieces for each player;

a king piece for each player;

a first die having a plurality of chess piece designations disposed thereupon;

a second die having indicia for numbers 1-6 disposed thereupon; and a board for game play, wherein the king piece has a king designation on one side thereof visible when placed on a reverse side of a standard checker; and each of the plurality of game pieces for each player, except for the king piece when turned to view the king designation, appears the same.

2. The game of claim 1, wherein the plurality of game pieces for a first player are distinguished from a plurality of game pieces of a second player.

3. The game of claim 1, wherein the board is a checkered board having an eight-by-eight grid alternating between a light color and a dark color.

4. The game of claim 1, wherein the first die includes a king facet, a queen facet, a bishop facet, a pawn facet, a rook facet and a knight facet.

* * * * *